United States Patent [19]

DeLeo

[11] Patent Number: 4,744,765

[45] Date of Patent: May 17, 1988

[54] HIGH VOLTAGE GROUND STUD

[75] Inventor: John DeLeo, 107 Sun Valley Dr., Southington, Conn. 06489

[73] Assignee: John DeLeo, Southington, Conn.

[21] Appl. No.: 63,974

[22] Filed: Jun. 19, 1987

[51] Int. Cl.[4] ..... H01R 4/66; H01R 4/70

[52] U.S. Cl. ..... 439/92; 174/138 F; 361/341; 439/142; 439/801; 439/904

[58] Field of Search ..... 439/92, 94, 625, 725, 439/727, 775, 801, 892, 904, 905, 933, 934, 135, 136, 142, 144, 147, 149, 367, 521, 750; 361/341, 365; 174/5 R, 5 SG, 138 F

[56] References Cited

U.S. PATENT DOCUMENTS 2,017,493 10/1935 Glowacki ..... 439/801

2,028,942 1/1936 Money ..... 439/725

FOREIGN PATENT DOCUMENTS 527930 10/1940 United Kingdom ..... 174/138 F

*Primary Examiner*—Gil Weidenfeld

*Assistant Examiner*—Gary F. Paumen

*Attorney, Agent, or Firm*—John DeLeo

[57] ABSTRACT

A high voltage ground stud and insulative enclosure consists of a double-ended bolt having one end threaded for attachment to the switchgear terminal bus, with the other end threaded for engaging the thermoplastic insulative enclosure. A thermoplastic insulative cap is arranged over that part of the stud that extends through the switchgear terminal bus. The insulating properties of the thermoplastic material virtually eliminate arcing between the ground stud and the surrounding atmosphere when the switchgear is energized with high voltage.

2 Claims, 3 Drawing Sheets

HIGH VOLTAGE GROUND STUD

BACKGROUND OF THE INVENTION

High voltage switchgear, as defined herein, consists of a metallic enclosure containing a plurality of industrial-rated high voltage circuit breakers capable of interrupting currents at applied voltages in excess of 1,000 volts. When the switchgear is de-energized, for inspecting and repairing associated industrial equipment, is is required by state and national electric codes that the switchgear terminal bus be connected directly with ground. In the event that the switchgear is inadvertently energized while such inspection and repair is ongoing, this would prevent serious damage to the personnel, as well as to the associated equipment.

Electrical connection with the high voltage switchgear terminal bus is made by employing a "hotstick" which generally includes a long insulated handle with means for mechanically manipulating an insulated hookshaped end. When the terminal lugs are attached to the high voltage switchgear terminal bus, an insulating cylindrical body terminating in an eyelet is attached over the terminal lug to prevent localized corona effects. A separate ground stud is bolted to the high voltage switchgear terminal bus to facilitate connecting the terminal bus to ground when the switchgear is de-energized. The ground connector generally comprises a spring-loaded clamp at one end of a heavy gauge metal conductor that is bolted to the system's ground terminal at an opposite end. An insulative cylinder, terminating in an eyelet, is arranged over the ground stud in the same manner as for the high voltage lugs. The threaded part of the ground stud that extends through the terminal bus is wrapped with electric insulating tape to prevent localized corona from otherwise occurring with exposed metal parts at voltages in excess of 1000 volts. To access the ground stud, the hooked end of the hotstick is inserted through the eyelet at the end of the insulative enclosure to unscrew the enclosure from the protected ground stud. Using the same hotstick, the ground conductor is attached to the exposed ground stud by means of the spring-loaded ground clamp. Before energizing the high voltage switchgear, the procedure is reversed and the ground connector clamp is removed. The insulative enclosure is positioned over the exposed ground stud and is threaded onto the exposed ground stud threads.

To assist in first attaching the ground stud to the switchgear terminals, a hex-shaped part is formed on the ground stud for receiving a wrench or similar tool. The The threads formed on the ground stud for engaging the switchgear bus conductor terminal is formed on the ground stud next to the hex-shaped part and the opposite side of the threads is turned to a diameter less than the threaded part to accommodate receiving the grounding clamp. Over long periods of continued use, the grounding clamp contacts the threaded part and eventually causes some of the threads to become impaired. When the insulative enclosure is next attached to the damaged stud threads, some portion of the ground stud accordingly remains exposed to the atmosphere. Localized corona arcing then occurs, causing pitting and erosion of the insulated enclosure until the ground stud and insulative enclosure must both be replaced. The arrangement of the electrical insulating tape around the threaded part of the ground lug that engages the high voltage switchgear terminal bus, must be cut away in order to allow the ground stud to be removed and replaced. Further, in damp locations, moisture can eventually penetrate through the taped part of the ground stud, which then requires removal and replacement of the insulating tape.

One purpose of the instant invention is to provide a ground stud arrangement that readily facilitates connection and removal of the ground stud from the high voltage switchgear terminal bus without damaging the ground lug threads and without causing any localized corona formation whatsoever.

SUMMARY OF THE INVENTION

A double-ended ground stud conductor is formed from a single piece of metal stock, wherein a first plurality of threads are formed on end end of the stud for attachment to a high voltage switchgear terminal bus and an insulative cap. A second plurality of threads are formed on an opposite end for attachment to an insulative enclosure. An extended shank portion of larger diameter extends between the threaded ends and includes a hex-shaped part, which allows the use of a wrench for ease of attachment to the switchgear bus.

DESCRIPTION OF THE PREFERRED EMBODIMENT

Figure 1:
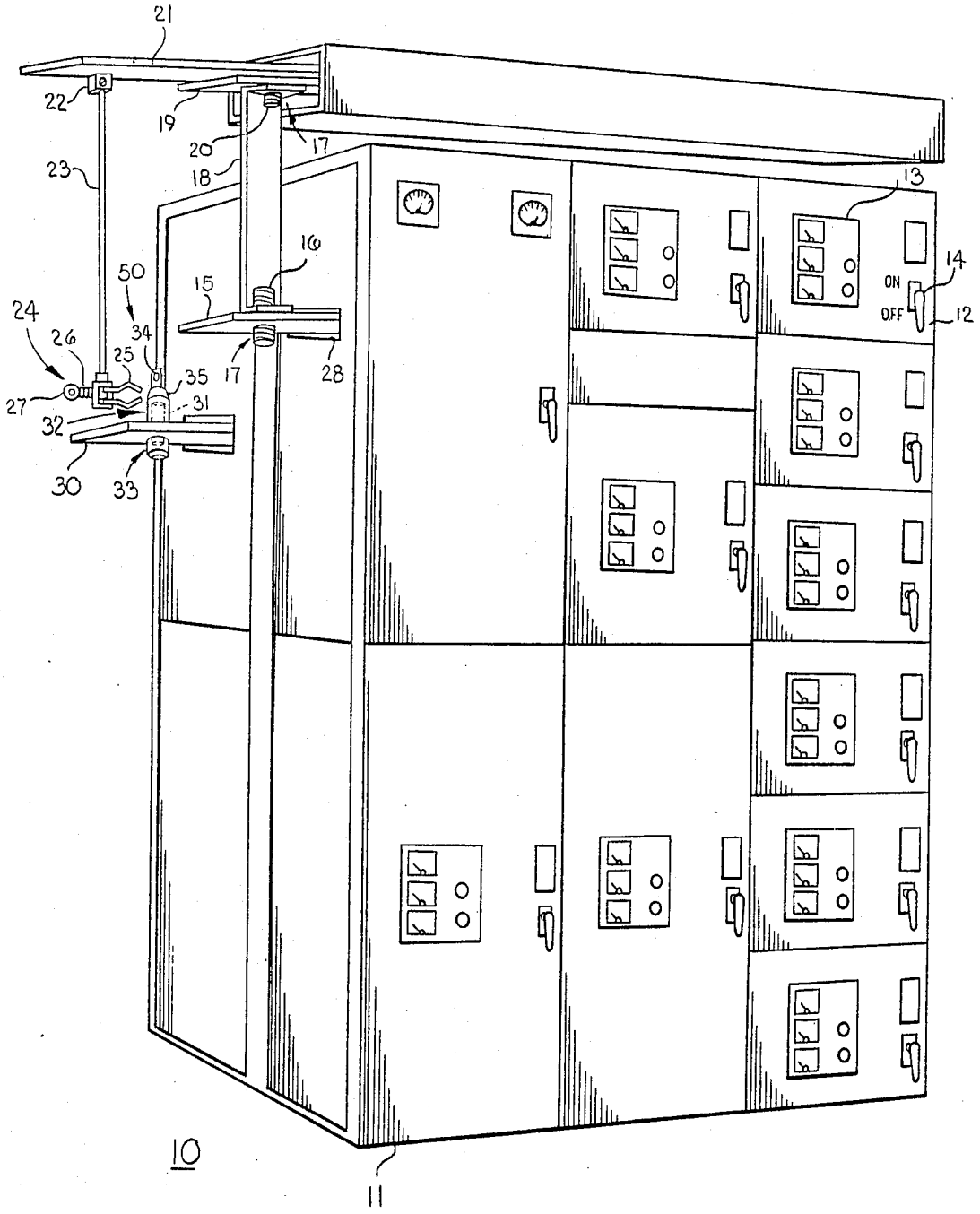
FIG. 1 is a front perspective view of high voltage switchgear cabinet with the ground stud assembly, according to the invention.

A high voltage switchgear assembly 10, as depicted in FIG. 1, includes a cabinet 11 containing a plurality of compartments 12 which contain a circuit breaker generally indicated at 13 to which operable access is made by means of a handle 14. For purposes of this disclosure, high voltage switchgear is defined as switchgear connected with a voltage source in excess of 1,000 volts. To supply the switchgear cabinet, a load terminal bus 15 connects from a line terminal lug 16 over a bus conductor 18 to the busway 19 and is connected to the busway by means of a lug 20. To prevent a localized corona discharge, electrical tape, generally indicated at 17, is applied to both the load terminal bus lug 16, and busway lug 20. The load terminal bus egresses from the cabinet 11 through an aperture 28, as indicated. For a three-phase power system, as is commonly employed with industrial type operations, a separate line terminal bus is connected within each separate phase (although only one such terminal bus 15 is shown herein for purposes of clarity). As described earlier, a ground stud assembly 50, which includes a ground stud 31 connected to a separate load terminal bus 30, is also connected within the high voltage switchgear. The ground stud assembly consists of an insulative closure 32, including an insulative case 35 arranged over the ground stud on one side of the load terminal bus 30. An eyelet 34 is formed within the insulative case 35 to facilitate the use of a "hotstick" by the operator, as earlier described. An insulative cap 33 is attached to the ground stud on the opposite side of the load terminal bus to prevent the formation of a corona discharge when the load terminal bus 30 is energized. When the switchgear is de-energized, by turning the circuit breaker handles 14 to their "OFF" position, no voltage should appear on the load terminal bus. To ensure that the load terminal bus remains de-energized and to prevent inadvertent damage to equipment and personnel, a systems ground bus 21 and ground conductor 23, which is attached to the ground bus at one end by means of a lug 22, is employed in the following manner. The hotstick (not shown) engages the eyelet 34, formed in the top of the insulative case 35, and unscrews the case from the threaded ground lug 31. The releasable clamp connector 24, attached to the opposite end of the ground conductor 23, is then grasped by engaging the eyelet 27 with the hotstick and clasping the jaws 25 around the ground lug 31. The jaws are spring-loaded together by means of a spring 26, such that when the hotstick is released from eyelet 27, the spring 26 holds the jaws 25 in good electrical connection with the ground lug 31. In the event that the circuit breakers 13 within the switchgear cabinet 11 are inadvertently turned to their "ON" position, any voltage appearing on the load terminal bus 15 will immediately drop to ground potential. The ground lug 31 is shown in detail in FIG. 2A and consists of an elongated cylindrical body or shank 38, terminating at a threaded case end 37 and at a threaded cap end 36. A hex skirt 39 is formed onto the lug and extends outward from the cylindrical shank 38 to accommodate the use of a wrench for attaching the ground stud without damaging the threads on either end.

Figure 2B:
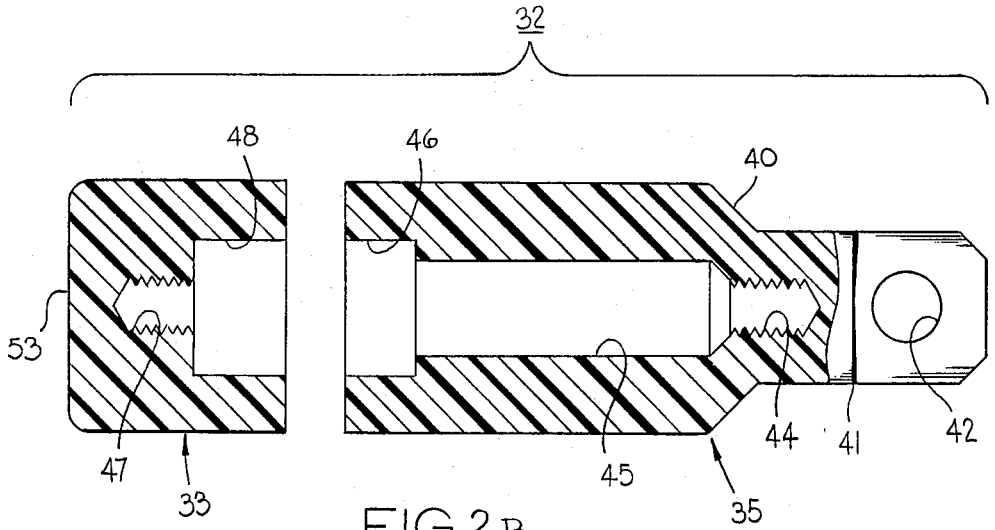
FIG. 2B is a side sectional view of the insulating closure surrounding the ground stud depicted in FIG. 2A.
Figure 2A:
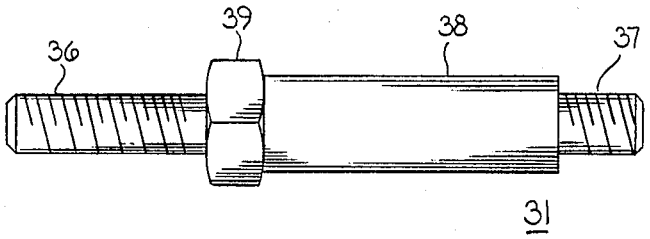
FIG. 2A is a side view of the ground stud contained within the ground stud assembly of FIG. 1.

The insulative closure 32 is depicted in FIG. 2B and consists of the insulative case 35 and the insulative cap 33. The insulative case 35 is turned from an insulative solid cylinder of a thermoplastic material such as DELRIN, which is a trademark of the Dupont Company for a poly acetal resin. The insulative case is formed into a cylindrical body 40 with a turned-down end 41. To accommodate the "hot-stick", an eyelet 42 is provided through the turned-down end. To secure the case to the ground stud, a plurality of internal threads 44 are cut within the turned-down end of the case. An internal shank slot 45 is cut into the interior of the cylindrical body to accommodate the elongated cylindrical shank 38 of the ground stud 31 shown in FIG. 2A and an internal slot 46 is cut within the opposite end of the cylindrical body to accommodate the hex skirt 39. To completely enclose the threaded cap end 36, the insulative cap 33, terminating in a closed end 53, is formed from the same insulative material. A complementary internal slot 48 is formed within the insulative cap opposite the closed end and a plurality of internal threads 47 are cut within the closed end for attachment of the threaded cap to the ground stud 31.

Figure 3:
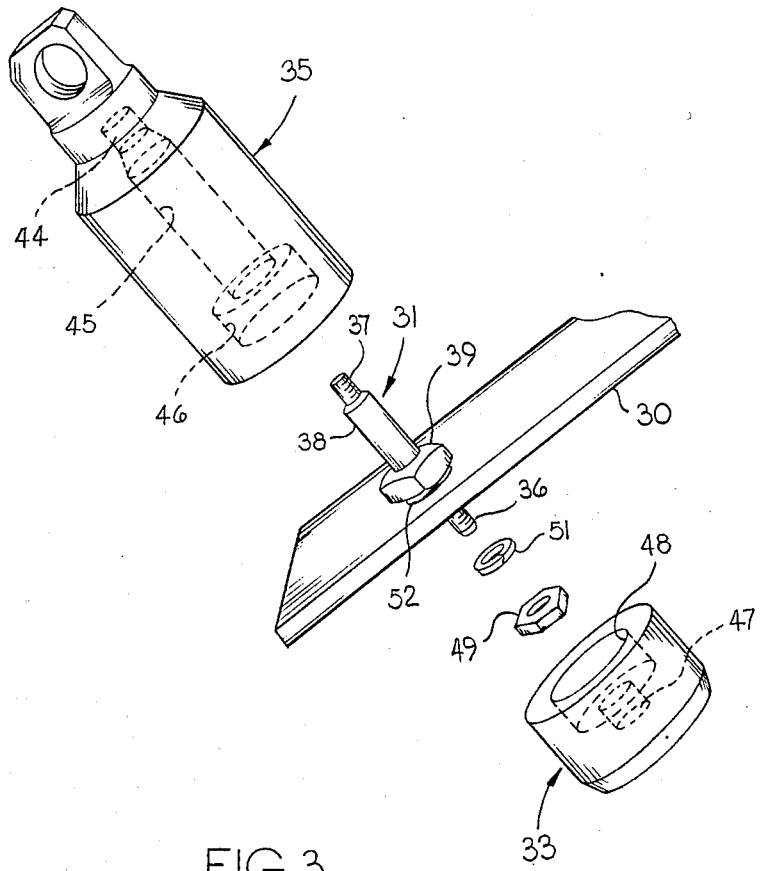
FIG. 3 is a front perspective view, in isometric projection, of the ground stud assembly of FIG. 1 prior to attachment to the line terminal bus.

The attachment of the insulative enclosure to the ground stud 31 is best seen by referring now to FIG. 3. The ground stud 31 is first attached to the load terminal bus 30 by placing the threaded end 36 through a clearance hole 52, formed within the load terminal bus. A lock washer 51 is arranged around the threads that extend beyond the load terminal bus and a nut 49 is applied to the threads and is tightly secured. The insulative cap 33 is next positioned over the threaded end 36 and is secured to the internal threads 47 formed within the insulative cap, while the hex nut 49 is received within the internal slot 48, formed within the insulative cap ahead of the internal threads. The insulative case 35 is next positioned over the elongated cylindrical shank 38 and the hex skirt which sit within the internal shank slot 45 and the internal slot 46 respectively. The internal threads 44 are engaged with the threaded end 37 which tightly fastens the insulative case 35 to the ground lug 31.

The complete ground lug assembly 50, best seen by referring back to FIG. 1, now presents an accessible ground stud 31, having no exposed parts for localized corona discharge without requiring a separate covering of electrical tape. The tight coupling between both the insulative cap 33 and the insulative case 35 on opposite sides of the load terminal bus 30 also prevents moisture or insects from coming in contact with the ground stud 31 contained therein.

A ground stud assembly has herein been described for ground connection with the load terminal bus of a high voltage switchgear cabinet. The insulative properties of the cap and case protect the ground stud from adverse environmental effects, while preventing localized corona discharge from occurring when the switchgear load terminal bus is energized.

Having thus described my invention, what I claim as new and desire to secure by Letters Patent is:

1. A ground stud assembly for high voltage apparatus comprising in combination:

a ground stud consisting of an elongated metal cylinder, threaded at both ends and including a raised hex skirt for accommodating an attachment tool;

an insulative plastic case consisting of a cylindrical case member having a first internal slot receiving said cylinder, a second internal slot receiving said hex skirt and internal threads receiving one of said threaded ends; and an insulative plastic cap consisting of a cylindrical cap member having an internal slot receiving a hex nut joining said ground stud to a high voltage terminal bus and internal threads receiving another of said threaded ends, and an eyelet formed within an exterior surface of said cylindrical case member for accommodating a hotstick, said case and cap comprising thermoplastic resin, said cap member internal threads extending a longer distance along said elongated cylinder than said case member internal threads.

2. An insulative enclosure for a high voltage ground stud comprising:

an insulative plastic case consisting of a cylindrical body member having a first internal slot adapted for receiving an elongated cylindrical metallic threaded ground stud and a second internal slot adapted for receiving a hex-skirt formed circumferentially on said cylindrical ground stud; and an insulative plastic cap having an internal slot adapted for receiving a hex nut holding said ground stud to a high voltage bus conductor and internal threads at one end of said internal slot adapted for receiving threads on said threaded ground stud, said insulative plastic case including an eyelet integrally formed on an exterior surface for accommodating a hotstick.

* * * * *